US011390415B2

(12) United States Patent
Apps et al.

(10) Patent No.: US 11,390,415 B2
(45) Date of Patent: Jul. 19, 2022

(54) NESTABLE BOTTLE CRATE

(71) Applicant: Rehrig Pacific Company, Los Angeles, CA (US)

(72) Inventors: William P. Apps, Alpharetta, GA (US); Suzanne Clark Ward, Santa Monica, CA (US); Shelby Frances Apps, Brookhaven, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 172 days.

(21) Appl. No.: 16/662,966

(22) Filed: Oct. 24, 2019

(65) Prior Publication Data

US 2020/0130885 A1 Apr. 30, 2020

Related U.S. Application Data

(60) Provisional application No. 62/750,418, filed on Oct. 25, 2018.

(51) Int. Cl.

| | |
|---|---|
| ***B65D 21/032*** | (2006.01) |
| ***B65D 1/24*** | (2006.01) |
| ***B65D 71/70*** | (2006.01) |
| ***B65D 21/04*** | (2006.01) |

(52) U.S. Cl.

CPC ..... *B65D 1/243* (2013.01); *B65D 21/048* (2013.01); *B65D 71/70* (2013.01); *B65D 2501/2407* (2013.01); *B65D 2501/2435* (2013.01); *B65D 2501/24133* (2013.01); *B65D 2501/24152* (2013.01); *B65D 2501/24191* (2013.01);

(Continued)

(58) Field of Classification Search

CPC .. B65D 2501/24719; B65D 2501/2407; B65D 2501/24133; B65D 2501/24191; B65D 2501/24152; B65D 2501/24541; B65D 2501/2435; B65D 1/243; B65D 71/70; B65D 21/048

USPC ..... 220/509

See application file for complete search history.

(56) References Cited

U.S. PATENT DOCUMENTS

| | | | |
|---|---|---|---|
| 820,445 | A | 5/1906 | Speer |
| D103,862 | S | 3/1937 | Randall et al. |
| 2,411,673 | A | 11/1946 | Vechey, Jr. |
| D147,981 | S | 11/1947 | Lehman |
| D152,907 | S | 3/1949 | Richards |
| 2,512,855 | A | 6/1950 | Erickson |

(Continued)

FOREIGN PATENT DOCUMENTS

| | | | |
|---|---|---|---|
| BE | 680197 | A | 10/1966 |
| BE | 693216 | A | 7/1967 |

(Continued)

*Primary Examiner* — Stephen J Castellano

(74) *Attorney, Agent, or Firm* — Carlson, Gaskey & Olds, P.C.

(57) ABSTRACT

A nestable beverage crate includes a base, side walls and end walls. Each side wall includes a plurality of side columns connecting a side upper band to the base. Each end wall includes a plurality of end columns connected an end upper band to the base. The side upper band and the end upper bands each have a plurality of peaks and valleys and are asymmetric, such that adjacent crates will have peaks aligned with valleys and vice-versa. For purposes of preventing shingling, the effective height of the side upper bands and the end upper bands these two adjacent side walls is the full distance between the upper edge of the peak and the lower edge of the valley, but the nesting height of the crate is only the height of the upper bands.

12 Claims, 9 Drawing Sheets

(52) U.S. Cl.
CPC ..... *B65D 2501/24541* (2013.01); *B65D 2501/24719* (2013.01)

(56) References Cited

U.S. PATENT DOCUMENTS 2,526,335 A 10/1950 Deichert
2,530,481 A 11/1950 Rawn, Jr.
2,535,493 A 12/1950 Gerber
2,588,805 A 3/1952 Cross
2,626,079 A 1/1953 Keller
D172,664 S 7/1954 Emery
2,743,030 A 4/1956 Read, Jr.
2,760,676 A 8/1956 Knieriem et al.
2,840,256 A 6/1958 Cobb, Jr.
2,928,530 A 3/1960 Sauey
2,935,222 A 5/1960 O'Connell
2,970,715 A 2/1961 Kappel et al.
D189,891 S 3/1961 Schilling et al.
2,974,819 A 3/1961 Melville
2,979,222 A 4/1961 Levine
3,009,579 A 11/1961 Ettinger, Jr.
3,055,531 A 9/1962 De Chelbor
3,055,542 A 9/1962 Russo
3,092,284 A 6/1963 Stout
D195,702 S 7/1963 Russo
3,106,308 A 10/1963 Kazimier
3,151,762 A 10/1964 Vidal
3,155,268 A 11/1964 Fogerty et al.
3,184,148 A 5/1965 Poupitch
D201,257 S 6/1965 Vidal et al.
3,247,996 A 4/1966 Garcia
3,283,947 A 11/1966 Cornelius
3,297,190 A 1/1967 Cloyd
D208,111 S 7/1967 Vidal et al.
3,332,574 A 7/1967 Earp
3,333,727 A 8/1967 Belcher et al.
3,333,729 A 8/1967 Rabb
3,334,767 A 8/1967 Cornelius et al.
3,349,943 A 10/1967 Box
D209,864 S 1/1968 Versteeg et al.
3,376,998 A 4/1968 Cornelius
3,384,261 A 5/1968 Austin
3,390,801 A 7/1968 Adomat
3,391,814 A 7/1968 Box
3,391,815 A 7/1968 Box
3,392,869 A 7/1968 Needt
3,416,694 A 12/1968 Bebb
3,428,207 A 2/1969 Schoeller
3,517,852 A 6/1970 Schoeller
3,628,684 A 12/1971 Sere et al.
3,638,824 A 2/1972 Sekiguchi et al.
3,682,351 A 8/1972 De Putter
3,701,449 A 10/1972 Schoeller
3,759,416 A 9/1973 Constantine
D229,674 S 12/1973 Quigg et al.
3,812,996 A 5/1974 Bunnell
3,865,239 A 2/1975 Herolzer et al.
D239,213 S 3/1976 Carroll et al.
3,949,876 A 4/1976 Bridges et al.
3,991,879 A 11/1976 Hirota
3,998,237 A 12/1976 Kressin et al.
3,998,328 A 12/1976 Box
RE29,262 E 6/1977 Utz
4,027,796 A 6/1977 Martin
4,037,722 A 7/1977 Bremer
4,040,517 A 8/1977 Torokvei
4,071,162 A 1/1978 Steinlein et al.
4,095,720 A 6/1978 Delbrouck et al.
4,101,049 A 7/1978 Wallace et al.
4,161,259 A 7/1979 Palafox
4,162,738 A 7/1979 Wright
4,202,448 A 5/1980 Jaeger et al.
4,204,596 A 5/1980 Davis
4,319,685 A 3/1982 David
4,344,530 A 8/1982 DeLarosiere
D266,709 S 10/1982 Box
4,410,099 A 10/1983 DeLarosiere
4,416,373 A 11/1983 DeLarosiere
D275,142 S 8/1984 Torokvei
4,538,742 A 9/1985 Prodel
4,548,320 A 10/1985 Box
D283,103 S 3/1986 Cushing et al.
4,585,137 A 4/1986 Poutiainen et al.
D284,841 S 6/1986 Rowland et al.
4,615,444 A 10/1986 DeLarosiere
D289,938 S 5/1987 Warwick
D291,178 S 8/1987 Toms
4,700,836 A 10/1987 Hammett
4,700,837 A 10/1987 Hammett
D295,107 S 4/1988 Frost
4,773,554 A 9/1988 Warwick
4,789,063 A 12/1988 Hammett
4,846,365 A 7/1989 Steinlein
4,848,580 A 7/1989 Wise
D304,123 S 10/1989 Warwick
4,899,874 A 2/1990 Apps et al.
4,911,303 A 3/1990 Andersson
4,928,841 A 5/1990 Arthurs
4,932,532 A 6/1990 Apps et al.
4,944,400 A 6/1990 Van Onstein et al.
4,978,000 A 12/1990 Mohr
4,978,002 A 12/1990 Apps et al.
D313,493 S 1/1991 Apps et al.
5,009,053 A 4/1991 Langenbeck et al.
D317,670 S 6/1991 Apps
D318,552 S 7/1991 Apps
5,031,749 A 7/1991 McCoy
5,031,774 A 7/1991 Morris et al.
D319,129 S 8/1991 Apps et al.
D320,298 S 9/1991 Apps et al.
5,060,819 A 10/1991 Apps
5,071,026 A 12/1991 Apps
5,078,282 A 1/1992 Stanfield
5,096,085 A 3/1992 Eek et al.
D325,279 S 4/1992 Apps
5,105,948 A 4/1992 Morris et al.
D326,749 S 6/1992 Apps et al.
D327,357 S 6/1992 Rehrig
D327,972 S 7/1992 Apps et al.
D329,931 S 9/1992 Apps
D329,932 S 9/1992 Apps
5,184,748 A 2/1993 Apps
5,267,649 A 12/1993 Apps et al.
5,305,884 A 4/1994 Apps et al.
5,316,172 A 5/1994 Apps et al.
5,320,245 A 6/1994 Apps et al.
5,335,814 A 8/1994 Hepp
D350,438 S 9/1994 Apps et al.
5,351,814 A 10/1994 Apps
5,377,862 A 1/1995 Oakes et al.
D356,679 S 3/1995 Apps et al.
5,405,042 A 4/1995 Apps et al.
5,421,477 A 6/1995 Hammett
D360,758 S 8/1995 Umiker
D361,431 S 8/1995 Koefelda
D361,663 S 8/1995 Kalin
5,445,273 A 8/1995 Apps
5,465,843 A 11/1995 Koefelda
5,487,487 A 1/1996 Hammett
5,495,945 A 3/1996 Apps et al.
5,501,352 A 3/1996 Apps
5,529,176 A 6/1996 Apps et al.
5,575,390 A 11/1996 Apps et al.
D378,249 S 3/1997 Apps et al.
D379,121 S 5/1997 Apps et al.
D379,717 S 6/1997 Apps et al.
D380,613 S 7/1997 Apps et al.
D380,901 S 7/1997 Apps et al.
5,651,461 A 7/1997 Apps et al.
5,660,279 A 8/1997 Apps et al.
5,702,022 A 12/1997 Umiker
5,704,482 A 1/1998 Apps et al.
5,769,230 A 6/1998 Koefelda
D395,954 S 7/1998 Apps et al.

(56) References Cited

U.S. PATENT DOCUMENTS

| | | | | |
|---|---|---|---|---|
| 5,785,170 | A | 7/1998 | Hammett | |
| D398,152 | S | 9/1998 | Kelly | |
| D399,060 | S | 10/1998 | Apps et al. | |
| D400,012 | S | 10/1998 | Apps | |
| 5,823,376 | A | 10/1998 | McGrath | |
| D401,764 | S | 12/1998 | Apps et al. | |
| 5,842,572 | A | 12/1998 | Apps et al. | |
| D404,204 | S | 1/1999 | Apps | |
| 5,855,277 | A | 1/1999 | Apps et al. | |
| D410,778 | S | 6/1999 | Apps et al. | |
| D412,399 | S | 8/1999 | Apps et al. | |
| 5,964,343 | A | 10/1999 | Steiner | |
| 5,971,204 | A | 10/1999 | Apps | |
| 5,979,654 | A | 11/1999 | Apps | |
| D417,784 | S | 12/1999 | Umiker | |
| 6,006,912 | A | 12/1999 | McGrath | |
| D420,220 | S | 2/2000 | Apps et al. | |
| 6,047,844 | A | 4/2000 | McGrath | |
| 6,073,793 | A | 6/2000 | Apps et al. | |
| 6,079,554 | A | 6/2000 | Hammett et al. | |
| 6,112,938 | A | 9/2000 | Apps | |
| 6,131,730 | A | 10/2000 | Hsu | |
| 6,186,328 | B1 | 2/2001 | Apps | |
| 6,189,734 | B1 | 2/2001 | Apps et al. | |
| 6,237,758 | B1 | 5/2001 | Hsu | |
| D446,015 | S | 8/2001 | Apps | |
| 6,401,960 | B1 | 6/2002 | Hammett | |
| D461,957 | S | 8/2002 | Hammett | |
| D462,522 | S | 9/2002 | Apps et al. | |
| 6,454,120 | B1 | 9/2002 | Hammett | |
| 6,457,599 | B1 | 10/2002 | Apps et al. | |
| D465,417 | S | 11/2002 | Apps | |
| D466,018 | S | 11/2002 | Apps | |
| D468,634 | S | 1/2003 | Hammett | |
| D483,946 | S | 12/2003 | Koefelda | |
| D485,756 | S | 1/2004 | Apps | |
| D487,634 | S | 3/2004 | Apps et al. | |
| 6,749,065 | B1 | 6/2004 | Hammett | |
| D494,867 | S | 8/2004 | Apps | |
| 6,851,563 | B1 | 2/2005 | Lipari | |
| D505,014 | S | 5/2005 | Apps et al. | |
| 6,892,885 | B2 | 5/2005 | Apps et al. | |
| 6,899,247 | B1 | 5/2005 | Koefelda et al. | |
| D507,880 | S | 8/2005 | Hassell et al. | |
| 6,966,442 | B2 | 11/2005 | Hassell et al. | |
| 7,011,215 | B2 | 3/2006 | Meissen et al. | |
| 7,017,746 | B2 | 3/2006 | Apps | |
| 7,036,666 | B2 | 5/2006 | Hammett | |
| 7,086,531 | B2 | 8/2006 | Apps et al. | |
| 7,093,715 | B1 | 8/2006 | Apps | |
| 7,097,033 | B2 | 8/2006 | Koefelda et al. | |
| 7,128,234 | B2 | 10/2006 | Apps et al. | |
| 7,207,458 | B1 * | 4/2007 | Koefelda | B65D 1/34 220/519 |
| 7,252,196 | B1 | 8/2007 | Koefleda et al. | |
| 7,281,641 | B2 | 10/2007 | Apps | |
| 7,311,217 | B2 | 12/2007 | Apps | |
| 7,322,475 | B2 | 1/2008 | Hassell et al. | |
| 7,322,486 | B2 | 1/2008 | Koefelda et al. | |
| 7,549,539 | B2 | 6/2009 | Apps | |
| 7,581,643 | B2 | 9/2009 | Wilskey et al. | |
| 7,604,122 | B2 | 10/2009 | Apps et al. | |
| 7,658,278 | B2 | 2/2010 | Apps et al. | |
| 7,677,405 | B2 | 3/2010 | Apps et al. | |
| 7,694,839 | B2 | 4/2010 | Koefelda et al. | |
| D615,758 | S | 5/2010 | Lindstrom | |
| 7,735,676 | B2 | 6/2010 | Ogburn | |
| 7,743,939 | B2 | 6/2010 | Stahl | |
| 7,950,521 | B2 | 5/2011 | Apps | |
| 8,056,753 | B2 | 11/2011 | Koefelda et al. | |
| 8,109,408 | B2 | 2/2012 | Hassell | |
| 8,123,034 | B2 | 2/2012 | Apps et al. | |
| 8,448,806 | B2 | 5/2013 | Hassell | |
| 8,474,617 | B2 | 7/2013 | Wiedmann et al. | |
| 8,636,142 | B2 | 1/2014 | Apps | |
| 8,672,161 | B2 | 3/2014 | Apps | |
| 8,720,688 | B2 | 5/2014 | Hassell et al. | |
| 8,960,479 | B2 | 2/2015 | Meers et al. | |
| 9,010,536 | B2 | 4/2015 | McCanless et al. | |
| 9,114,901 | B2 | 8/2015 | Apps | |
| 9,321,572 | B2 | 4/2016 | Apps et al. | |
| 10,029,824 | B2 | 6/2018 | Meers et al. | |
| D831,962 | S | 10/2018 | Apps et al. | |
| D843,111 | S | 3/2019 | Apps et al. | |
| 10,703,527 | B2 | 7/2020 | Apps et al. | |
| 2001/0015329 | A1 | 8/2001 | Apps et al. | |
| 2001/0019063 | A1 | 9/2001 | Apps | |
| 2002/0148837 | A1 | 10/2002 | Apps | |
| 2002/0195452 | A1 | 12/2002 | Apps | |
| 2003/0024844 | A1 | 2/2003 | Hammett | |
| 2003/0057211 | A1 | 3/2003 | Koefelda et al. | |
| 2003/0075546 | A1 | 4/2003 | Hammett | |
| 2005/0279651 | A1 | 12/2005 | Perret et al. | |
| 2007/0246392 | A1 | 10/2007 | Stahl | |
| 2009/0242568 | A1 | 10/2009 | Apps | |
| 2010/0084297 | A1 | 4/2010 | Apps | |
| 2010/0084302 | A1 | 4/2010 | Apps | |
| 2010/0147642 | A1 | 6/2010 | Andochick | |
| 2010/0170823 | A1 | 6/2010 | Koefelda et al. | |
| 2010/0258467 | A1 | 10/2010 | Apps | |
| 2011/0056861 | A1 | 3/2011 | Apps | |
| 2011/0240659 | A1 | 10/2011 | Orgeldinger | |
| 2012/0152789 | A1 | 6/2012 | Apps et al. | |
| 2014/0110303 | A1 * | 4/2014 | Meers | B65D 21/0215 206/775 |
| 2015/0014200 | A1 | 1/2015 | Apps et al. | |
| 2016/0016689 | A1 * | 1/2016 | Apps | B65D 1/243 206/141 |
| 2016/0159542 | A1 | 6/2016 | Meers | |
| 2018/0244422 | A1 | 8/2018 | Clark et al. | |

FOREIGN PATENT DOCUMENTS

| | | | |
|---|---|---|---|
| CA | 965056 | A | 3/1975 |
| CA | 1109433 | A1 | 9/1981 |
| DE | 1207268 | B | 12/1965 |
| DE | 2837910 | A1 | 3/1980 |
| DE | 102007050061 | A1 | 12/2008 |
| EP | 99827 | A1 | 2/1984 |
| EP | 0210712 | A2 | 2/1987 |
| EP | 464894 | A1 | 1/1992 |
| EP | 915021 | A1 | 5/1999 |
| EP | 1008527 | A1 | 6/2000 |
| EP | 2107006 | A1 | 10/2009 |
| FR | 1285689 | A | 2/1962 |
| FR | 1350962 | A | 1/1964 |
| FR | 1351218 | A | 5/1964 |
| FR | 1518610 | A | 3/1968 |
| FR | 2302244 | A1 | 9/1976 |
| GB | 758817 | A | 10/1956 |
| GB | 943947 | A | 12/1963 |
| GB | 1032916 | A | 6/1966 |
| GB | 1115343 | A | 5/1968 |
| GB | 1120067 | A | 7/1968 |
| GB | 1152038 | A | 5/1969 |
| GB | 1312701 | A | 4/1973 |
| GB | 1319726 | A | 6/1973 |
| GB | 1330778 | A | 9/1973 |
| GB | 2017645 | A | 10/1979 |
| GB | 2079256 | A | 1/1982 |
| GB | 2135278 | A | 8/1984 |
| GB | 2158044 | A | 11/1985 |
| NL | 6505562 | A | 10/1966 |
| WO | 8201536 | A1 | 5/1982 |
| WO | 9410053 | A1 | 5/1994 |
| WO | 9640566 | A1 | 12/1996 |
| WO | 9807636 | A1 | 2/1998 |
| WO | 9965779 | A1 | 12/1999 |
| WO | 0041937 | A1 | 7/2000 |
| WO | 2006026783 | A1 | 3/2006 |
| WO | 2009043038 | A1 | 4/2009 |

* cited by examiner

NESTABLE BOTTLE CRATE

This application claims the benefit of provisional application No. 62/750,418 filed 25 Oct. 2018.

BACKGROUND

Nestable beverage crates often include a base with side walls and end walls extending upward from side edges and end edges of the base, respectively. Each wall includes a plurality of columns extending from the base to an upper band. The columns and base of the crate are receivable between the upper bands of an identical crate when empty. The nested height of the crates is the height of the upper bands, i.e. each additional crate added to the stack will only increase the height of the stack by the vertical width of the upper bands. This nested height is efficient for storage and transportation when empty.

Sometimes adjacent crates will experience "shingling," in which the lower edge of one side wall rides up on top of the upper edge of an adjacent side wall. This is undesirable but can happen if one crate is tilted or lifted higher than the adjacent crate by a height equal to the vertical width of the upper band. Thus, decreasing the vertical width of the upper band can reduce the nesting height, but will increase the possibility of shingling.

SUMMARY

A nestable beverage crate includes a base, side walls and end walls. Each side wall includes a plurality of side columns connecting a side upper band to the base. Each end wall includes a plurality of end columns connected an end upper band to the base. The side upper band and the end upper bands each have a plurality of peaks and valleys and are asymmetric, such that adjacent crates will have peaks aligned with valleys and vice-versa. For purposes of preventing shingling, the effective vertical width of the upper bands of these two adjacent side walls is the full distance between the upper edge of the peak and the lower edge of the valley, but the nesting height of the crate is only the vertical width of the upper bands.

DETAILED DESCRIPTION OF A PREFERRED EMBODIMENT

Figure 1:
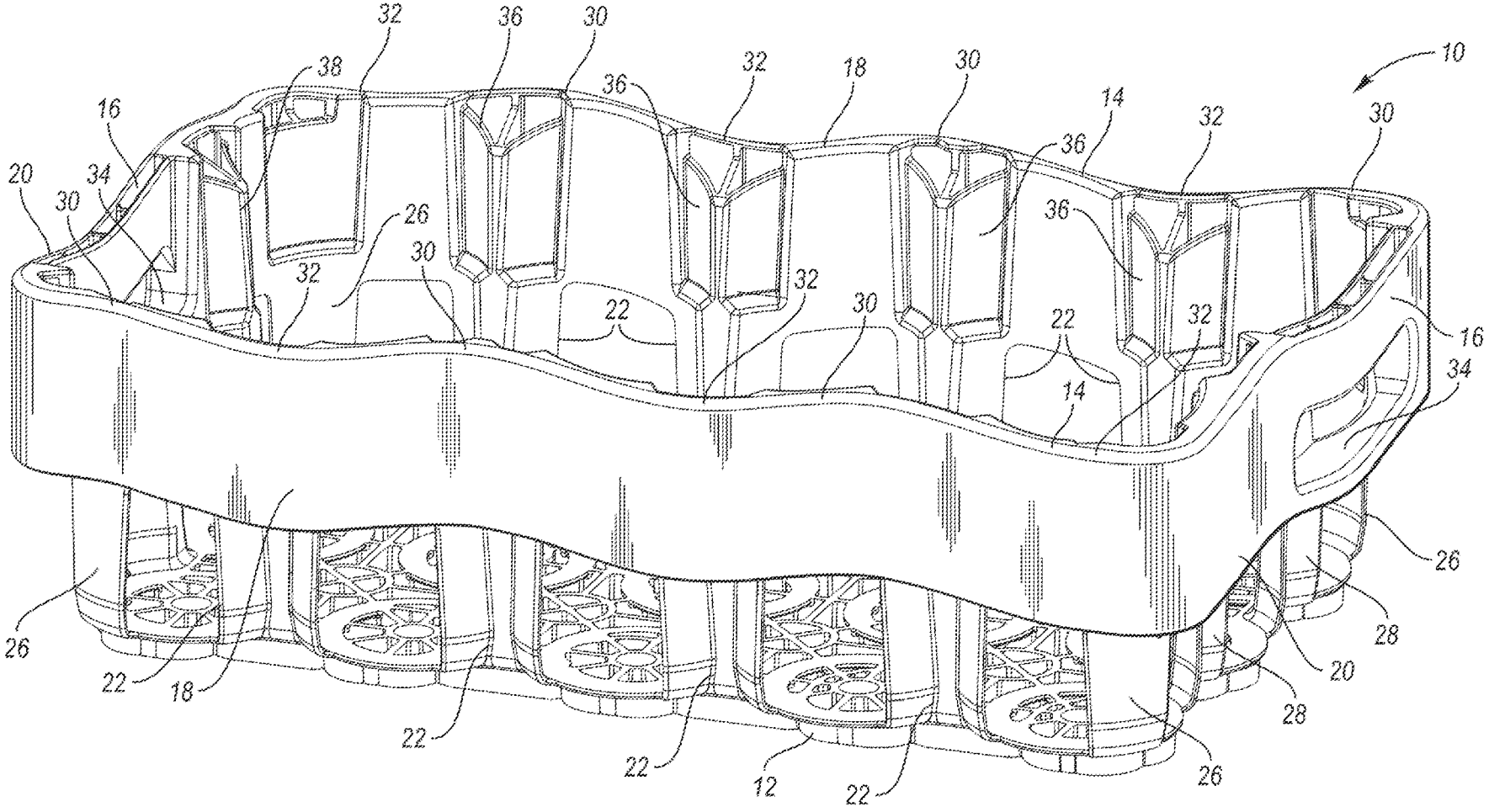
FIG. 1 is a perspective view of a nestable crate according to one embodiment.

FIG. 1 is a perspective view of a nestable beverage crate 10 having a base 12. Side walls 14 extend upward from side edges of the base 12. End walls 16 extend upward from end edges of the base 12. The side walls 14 each include a side upper band 18. The end walls 16 each include an end upper band 20. The side upper bands 18 and end upper bands 20 together are continuous about the entire periphery of the crate 10. Columns 22 connect the side upper band 18 to the side edges of the base 12. Corner columns 26 extend downward from corners where the side upper bands 18 and end upper bands 20 meet. End columns 28 extend downward from the end upper bands 20 on the end walls 16.

The side upper bands 18 are asymmetric about a plane extending perpendicularly between midpoints of the two side upper bands 18. Each side upper band 18 includes a plurality of peaks 30 alternating with a plurality of valleys 32, on the upper edge of the side upper band 18. At one end of the side upper band 18 (or corner) is a peak 30, while at the opposite end or corner of that side upper band 18 is a valley 32. The peaks 30 on one side upper band 18 align with valleys 32 on the other side upper band 18 and vice versa. In other words, the side upper bands 18 are the same, not mirror images of one another.

A handle opening 34 is formed in each end wall. Each handle opening 34 is offset from the center of the end walls 16 toward a different one of the side walls 14. Each handle opening is centered on one of the end columns 28.

A plurality of interior projections 36 are formed on the interior sides of the side upper bands 18 and are aligned with the side columns 22. Interior projections 38 are also aligned with the end columns 28, but not over the handle openings 34.

The crate 10 is preferably injection molded as a single piece of suitable plastic.

Figure 2:
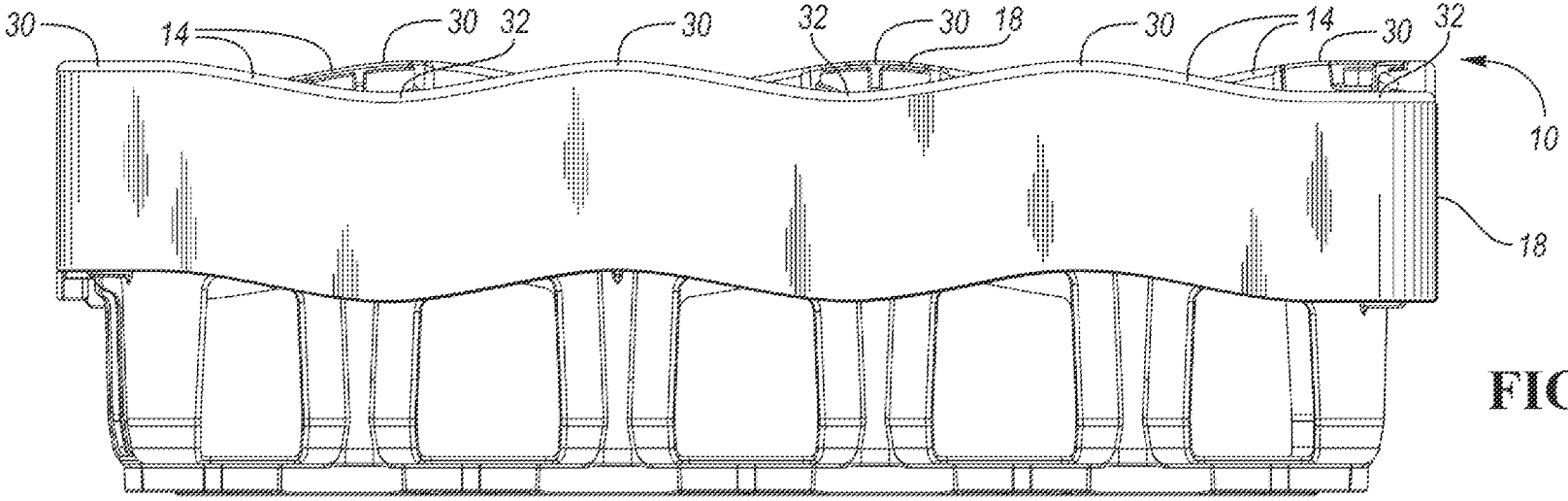
FIG. 2 is a side view of the crate of FIG. 1.
Figure 3:
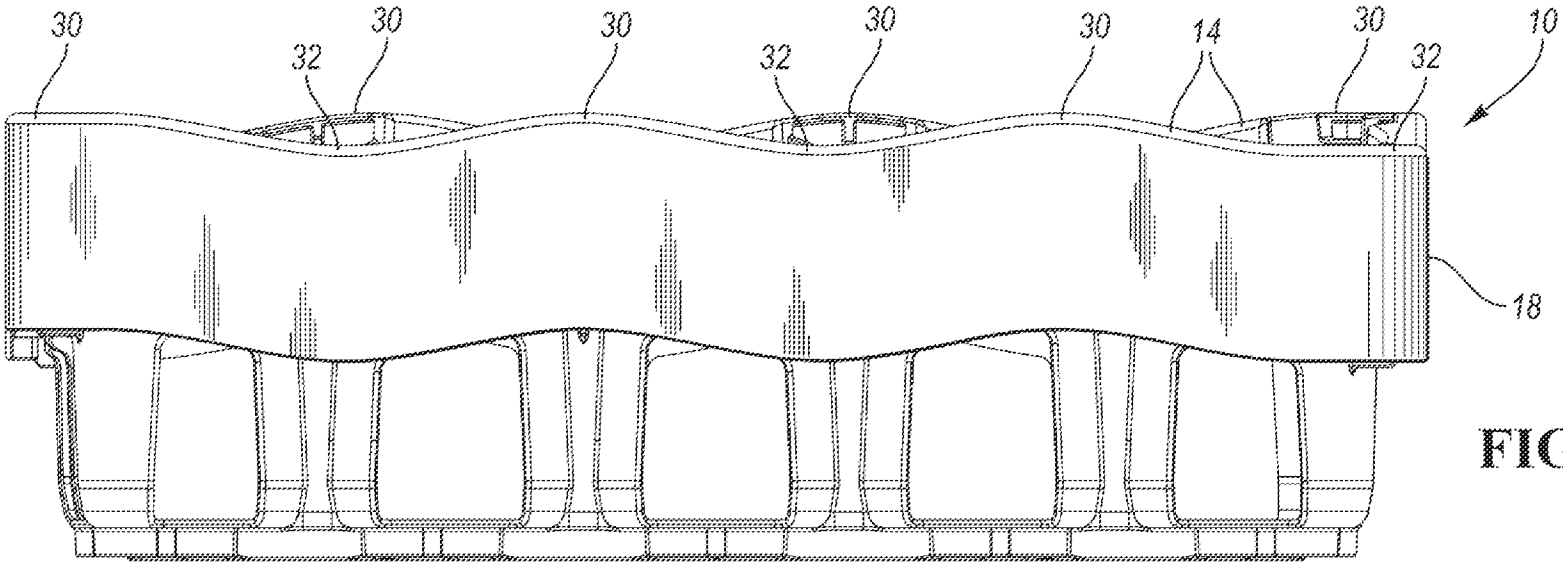
FIG. 3 shows the opposite side view of the crate of FIG. 2.

FIG. 2 is a side view of the crate 10. As shown, the peaks 30 at the upper edge of one side upper band 18 are aligned with the valleys 32 of the other side upper band 18 and vice versa. The lower edge of the side upper bands 18 rides and falls with the upper edge of the side upper band 18 so that the side upper band 18 has substantially uniform height. FIG. 3 is a side view of the crate 10 showing the opposite side wall 14 to that of FIG. 2. Again, the side upper bands 18 are asymmetric and are the same, not mirror images of one another.

Figure 4:
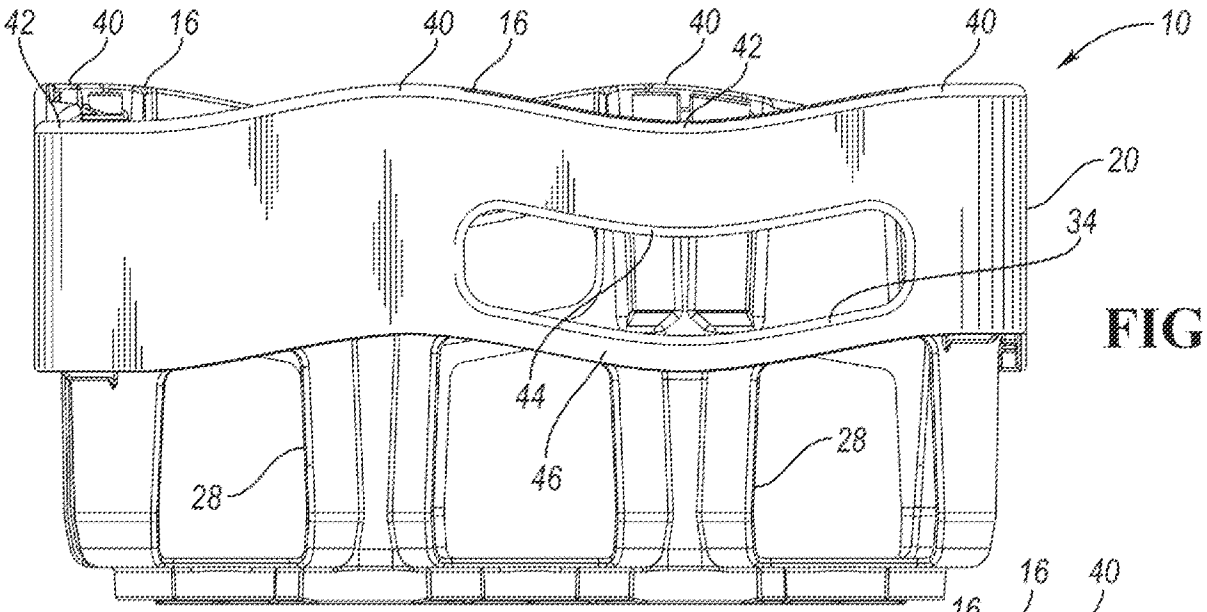
FIG. 4 is an end view of the crate of FIG. 1.

FIG. 4 is an end view of the crate 10. Each end wall 16 also includes a plurality of alternating peaks 40 and valleys 42, as reflected in the upper edge of the end upper band 20. The peaks 40 of one end wall 16 align with the valleys 42 of the opposite end wall 16 and vice versa. The end upper bands 20 are asymmetric and are the same, not mirror images of one another. The lower edges of the end upper bands 20 rise and fall with the upper edge, so that the end upper band 20 maintains a substantially uniform height. The handle opening 34 of each end wall 16 is centered on a valley 42. The handle opening 34 is defined between an upper portion 44 and a lower portion 46, both having lower surfaces that are concave downward.

Figure 5:
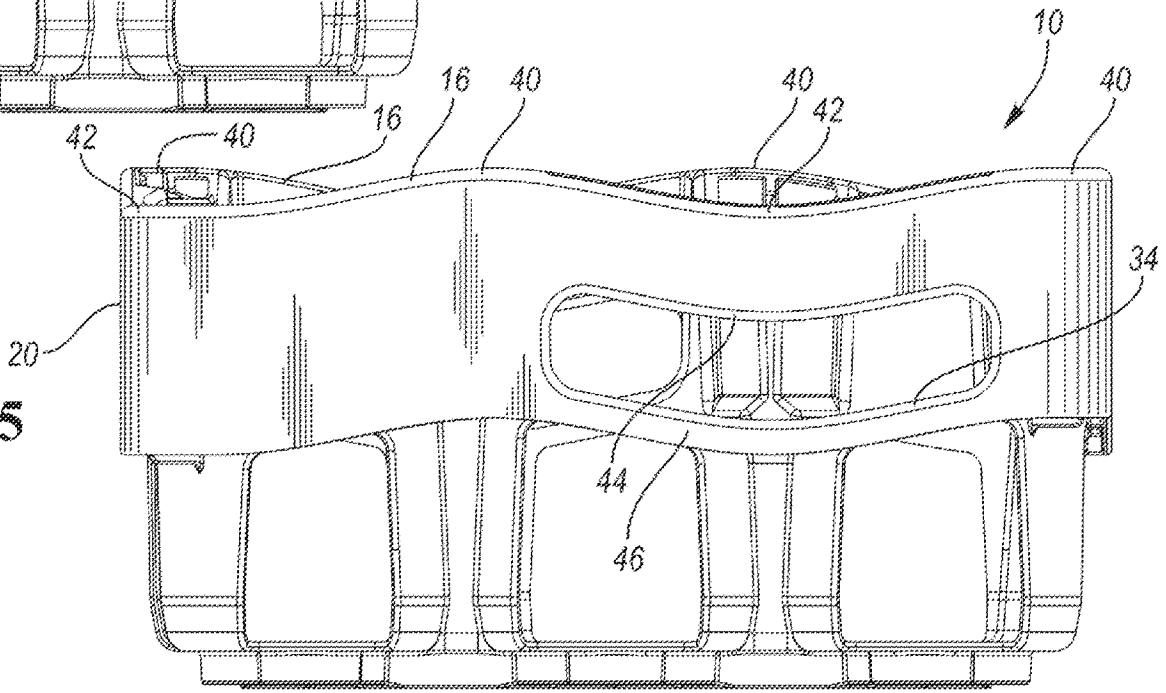
FIG. 5 shows the opposite end view of the crate of FIG. 4.

FIG. 5 is an end view of the opposite end wall 16 of the crate 10.

Figure 6:
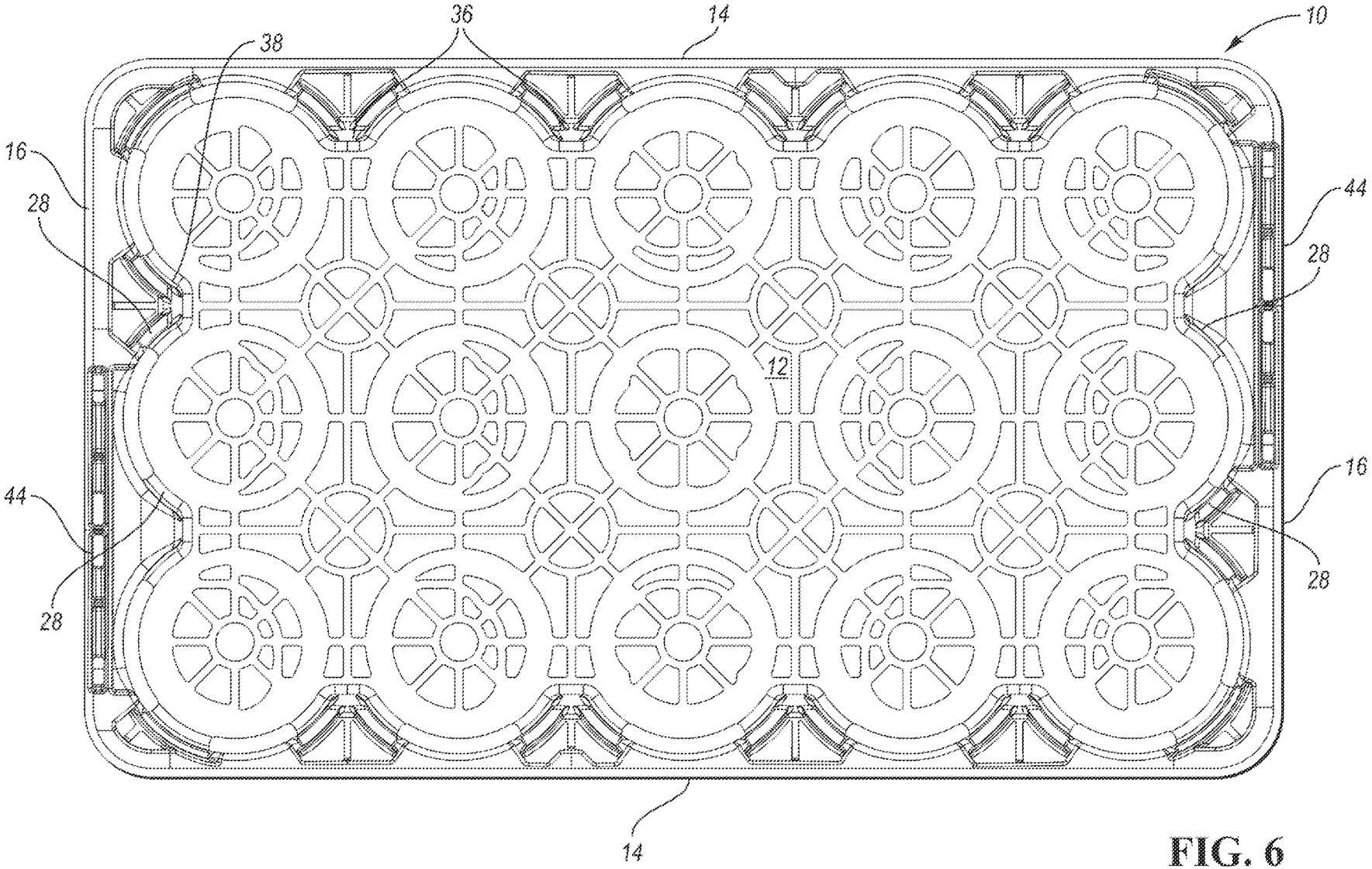
FIG. 6 is a top view of the crate of FIG. 1.

FIG. 6 is a top view of the crate 10. As shown, the upper portions 44 of the handle openings 34 (not visible) are offset toward opposite side walls 14. The upper portions 44 of the handles are centered on columns 28 that are aligned between bottle receiving pockets in the crate 10. This permits the handles and end walls 16 to be positioned closer to one another and still leave enough room for the user's hand because the user's hand will be aligned with the space between the cylindrical bodies of the bottles.

Figure 7:
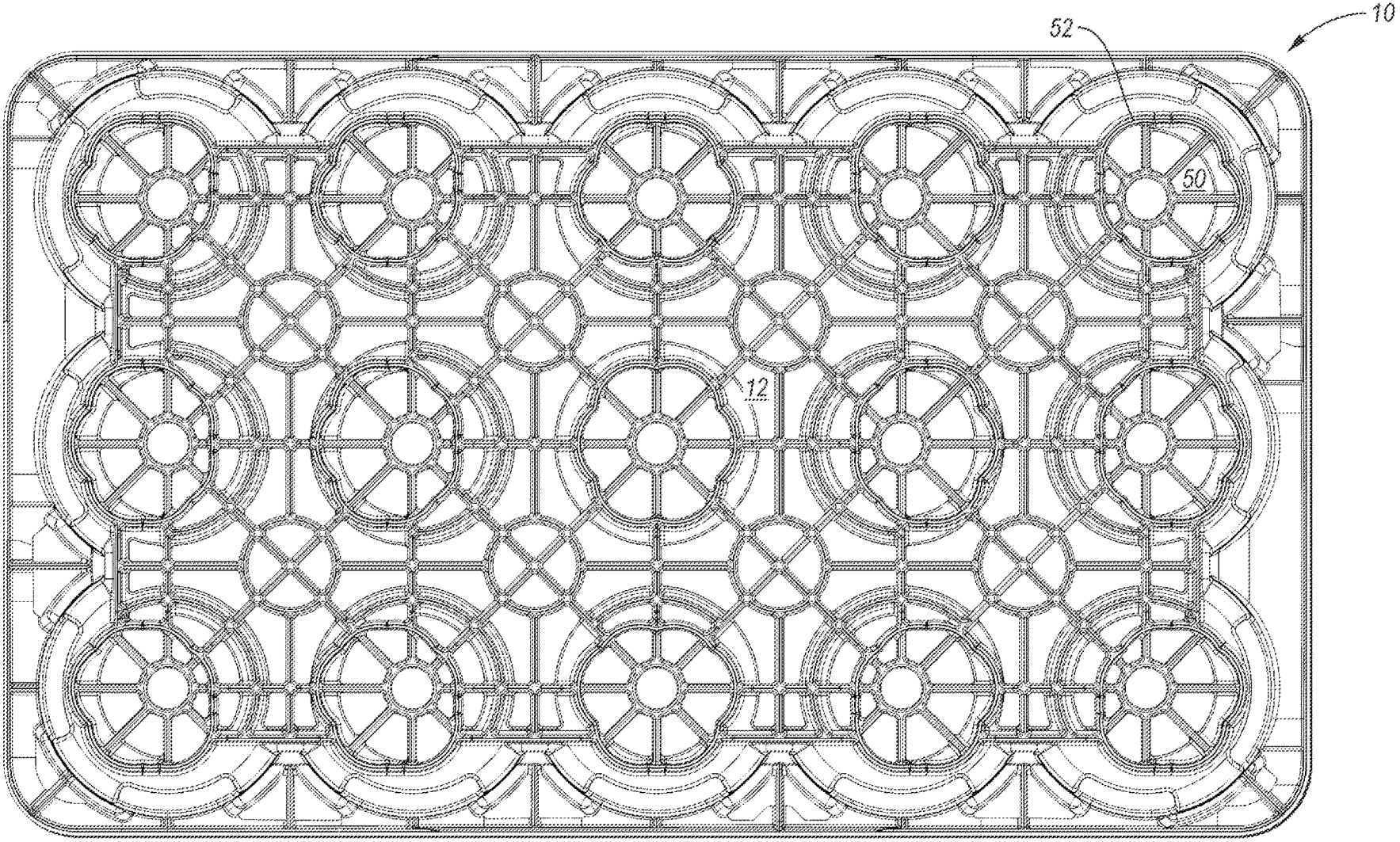
FIG. 7 is a bottom view of the crate of FIG. 1.

FIG. 7 is a bottom view of the crate 10. A plurality of bottle cap receiving areas 50 (in this example, 15 in a 3×5 array) are defined by perimeter ribs 52, which preferably provide full bottle cap capture of the bottle caps of bottles on which the crate 10 is stacked.

Figure 8:
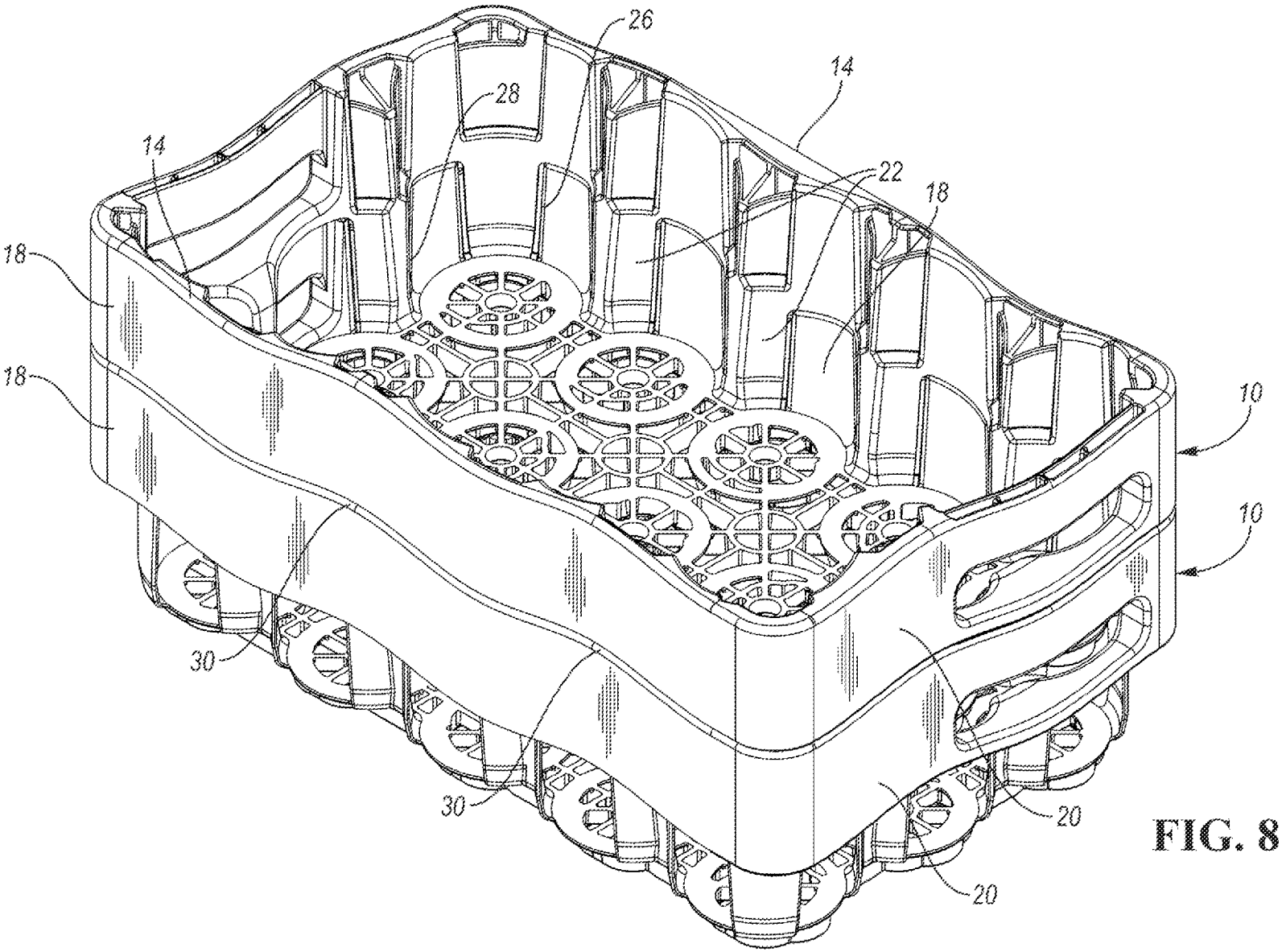
FIG. 8 shows the crate of FIG. 1 nested in an identical crate.

FIG. 8 shows the crate 10 nested in an identical empty crate 10. The columns 22, 26, 28 are received between the side upper bands 18 of the empty crate 10 below. The upper edges of the side upper bands 18 are complementary to the lower edges of the side upper bands 18 of the upper crate 10. Similarly, the upper edges of the end upper bands 20 are complementary to the lower edges of the end upper bands 20 of the upper crate 10. As a result, as shown in FIG. 8, the nesting height of the crates 10 is the vertical width of the upper bands 18, 20. However, as shown in FIGS. 9 and 11, for purposes of preventing shingling, the effective height of the side upper bands 18 or end upper bands 20 of the two adjacent crates 10 is the full distance between the upper edge of a peak and the lower edge of a valley of the upper bands 18, 20.

Figure 9:
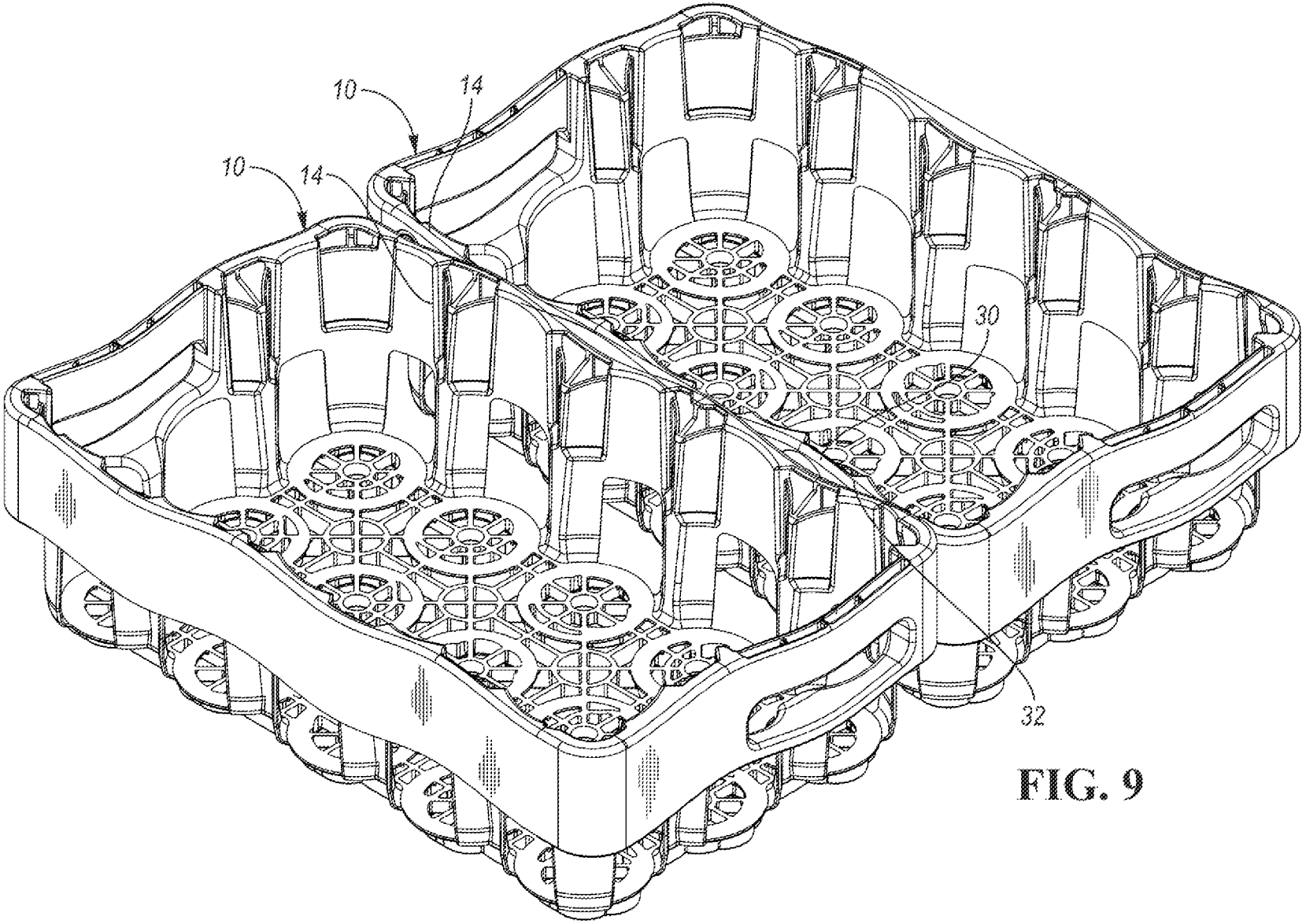
FIG. 9 shows two of the crates of FIG. 1 with their side walls abutting.

In FIG. 9, two crates 10 have their side walls 14 abutting. The peak 30 of one side wall aligns with the valley 32 of the adjacent side wall, and vice versa. As far as preventing shingling, in which the lower edge of one side wall 14 rides up on top of the upper edge of an adjacent side wall 14, the effective height of the side upper bands 18 of these two adjacent side walls 14 is the full distance between the upper edge of the peak 30 of one side wall 14 and the lower edge of the valley 32 of the adjacent side wall 14. Thus, prevention of shingling is increased without a corresponding increase in the nesting height of the empty crates (FIG. 8).

Figure 10:
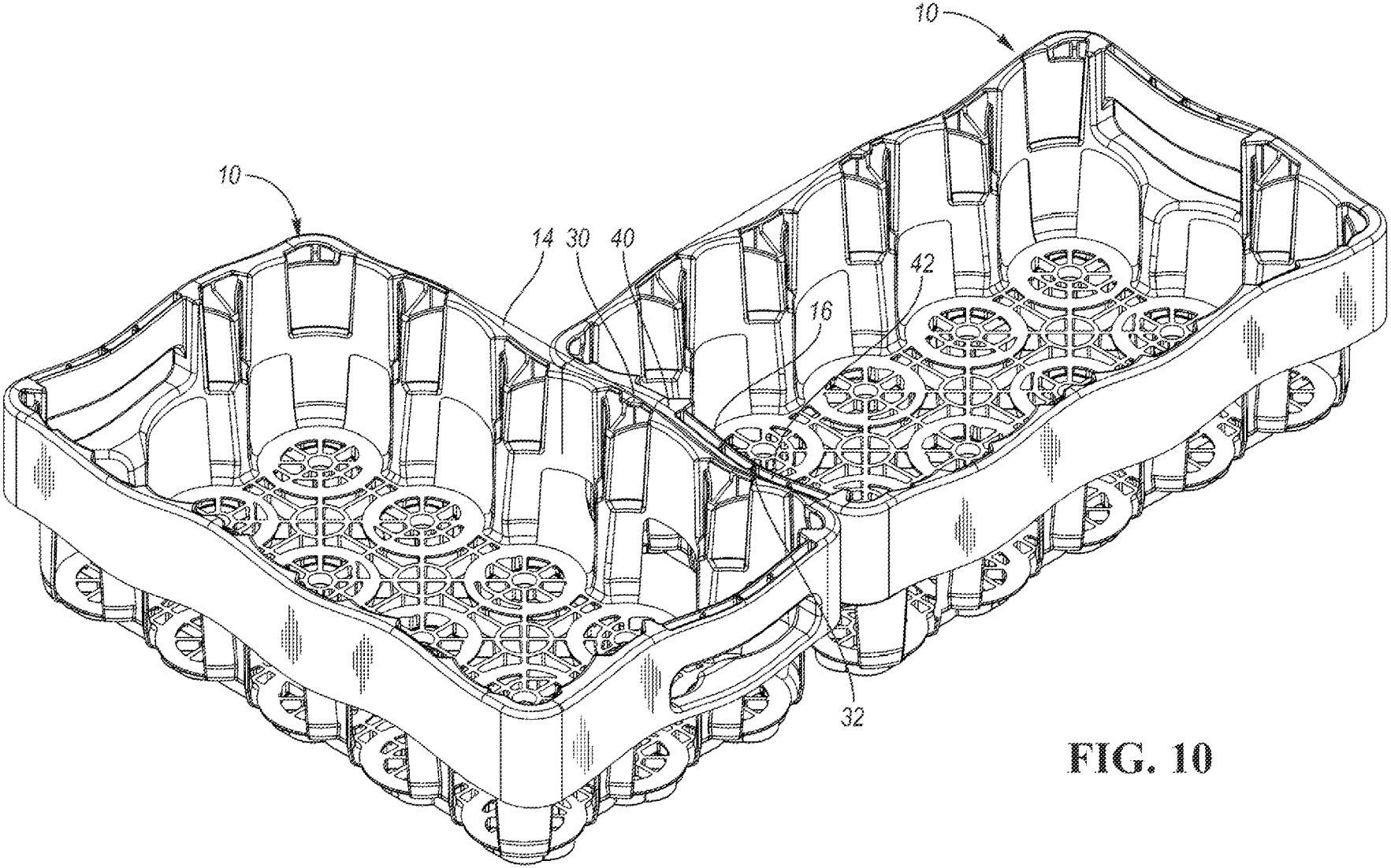
FIG. 10 shows one of the crates of FIG. 9 with an end wall abutting a side wall of the other crate of FIG. 9.

Referring to FIG. 10, when an end wall 16 of one crate 10 abuts the side wall 14 of an identical crate 10, however, this anti-shingling advantage is not realized as in FIG. 9. Only the actual vertical width of the upper bands 18, 20 prevents shingling.

Figure 11:
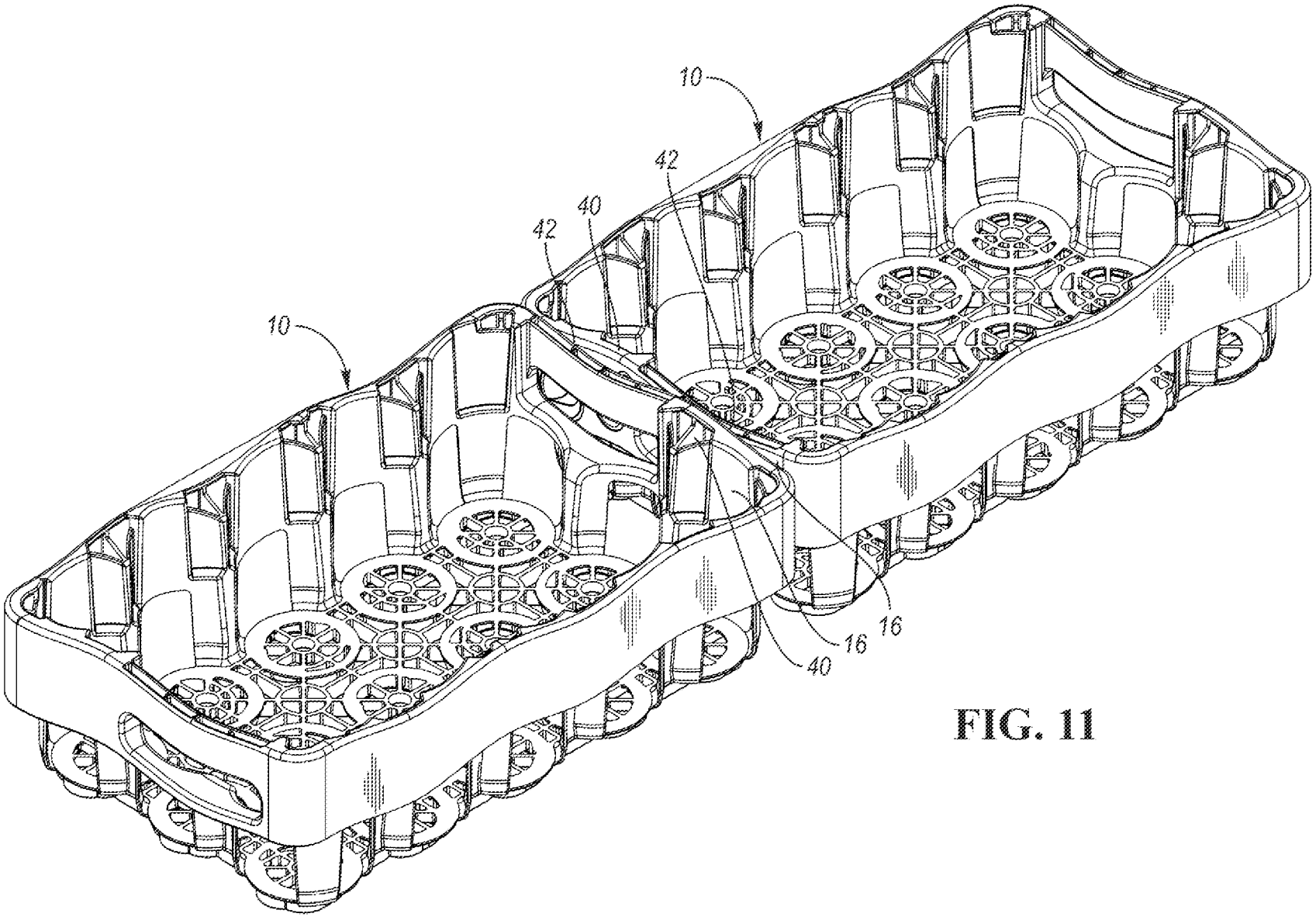
FIG. 11 shows the crates of FIG. 9 with end walls abutting one another.

In FIG. 11, the crates 10 are arranged with abutting end walls 16. In this arrangement, once again, the peaks 40 of each end wall 16 align with the valleys 42 of the adjacent end walls. This again provides the anti-shingling advantage without the corresponding increase in nesting height.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A nestable beverage crate comprising:

a base having opposed side edges and opposed end edges;

side walls extending upward from the side edges of the base, each of the side walls including a plurality of side columns connecting a side upper band to the respective side edge of the base, wherein the side upper bands are each asymmetric about a plane extending through midpoints of the side upper bands perpendicularly to the side upper bands and to the base, each side upper band having an uppermost edge including a plurality of peaks and a plurality of valleys, wherein one of the side upper bands is not a mirror image of the other of the side upper bands; and end walls extending upward from the end edges of the base, each of the end walls including a plurality of end columns connecting an end upper band to the respective end edge of the base, where the end upper bands are each asymmetric about a plane extending through midpoints of the end upper bands perpendicularly to the end upper bands and to the base, each end upper band having an uppermost edge including a plurality of peaks and a plurality of valleys, the end upper bands joining the side upper bands in corners, wherein one of the valleys of the uppermost edge of each of the end upper bands is in one of the corners, wherein one of the peaks of the uppermost edge of one of the end upper bands abuts one of the side walls and wherein one of the valleys of the uppermost edge of the other of the end upper bands abuts the one of the side walls.

2. The nestable beverage crate of claim 1 wherein one of the peaks of the uppermost edge of each of the end upper bands is in an other of the corners, such that the peak of the uppermost edge in the other of the corners of each of the end upper bands joins continuously with one of the peaks of the uppermost edge of one of the side walls.

3. The nestable beverage crate of claim 1 wherein each end upper band includes a handle opening aligned with an other one of the plurality of valleys of the uppermost edge.

4. The nestable beverage crate of claim 1 wherein the side columns and the end columns are receivable between the side upper bands and end upper bands of an identical crate nested therebelow.

5. The nestable beverage crate of claim 1 wherein an underside of the base includes a 3×5 array of bottle cap receiving recesses formed therein.

6. The nestable beverage crate of claim 1 wherein the side upper bands each have a lowermost edge that rises and falls with the respective uppermost edge, such that each side upper band maintains a substantially constant vertical width from one end wall to the other end wall.

7. The nestable beverage crate of claim 1 wherein a nesting height of the nestable beverage crate is the height of the side upper bands.

8. The nestable beverage crate of claim 1 wherein the uppermost edge of the one of the side upper bands is the same as the uppermost edge of the other of the side upper bands.

9. The nestable beverage crate of claim 1 wherein one of the peaks of the uppermost edge of one of the side upper bands abuts one of the peaks of the uppermost edge of one of the end walls and wherein one of the valleys of the uppermost edge of the other of the side upper bands abuts one of the valleys of the uppermost edge of the one of the end walls.

10. A nestable beverage crate comprising:

a base having opposed side edges and opposed end edges;

side walls extending upward from the side edges of the base, each of the side walls including a plurality of side columns connecting a side upper band to the respective side edge of the base, wherein the side upper bands are each asymmetric about a plane extending through midpoints of the side upper bands perpendicularly to the side upper bands and to the base, each side upper band having an uppermost edge including a plurality of peaks and a plurality of valleys; and end walls extending upward from the end edges of the base, each of the end walls including a plurality of end columns connecting an end upper band to the respective end edge of the base, where the end upper bands are each asymmetric about a plane extending through midpoints of the end upper bands perpendicularly to the end upper bands and to the base, each end upper band having an uppermost edge including a plurality of peaks and a plurality of valleys, the end upper bands joining the side upper bands in corners, wherein one of the valleys of the uppermost edge of each of the end upper bands is in one of the corners, wherein one of the peaks of the uppermost edge of one of the end upper bands is in a corner abutting one of the side walls and wherein one of the valleys of the uppermost edge of the other of the end upper bands is in a corner abutting the one of the side walls.

11. A nestable beverage crate comprising:

a base having an underside including a 3×5 array of bottle cap receiving recesses formed therein;

side walls extending upward from the sides the base, each of the side walls including a plurality of side columns connecting a side upper band to the base, each side upper band having an uppermost edge including a plurality of peaks and a plurality of valleys, wherein the side upper bands each have a lowermost edge that rises and falls with the respective uppermost edge, such that each side upper band maintains a substantially uniform vertical width, wherein one of the side upper bands is the same as the other of the side upper bands; and end walls extending upward from ends of the base, each of the end walls including a plurality of end columns connecting an end upper band to the base, each end upper band having an uppermost edge including a plurality of peaks and a plurality of valleys, the end upper bands joining the side upper bands in corners, wherein one of the valleys of the uppermost edge of each of the end upper bands is in one of the corners, wherein one of the peaks of the uppermost edge of each of the end upper bands is in the other of the corners, wherein each end upper band includes a handle opening aligned with an other one of the plurality of valleys of the uppermost edge, wherein the side columns and the end columns are receivable between the side upper bands and end upper bands of an identical crate nested therebelow, wherein one of the peaks of the uppermost edge of one of the side upper bands abuts one of the end walls and wherein one of the valleys of the uppermost edge of the other of the side upper bands abuts the one of the end walls, wherein one of the peaks of the uppermost edge of one of the end upper bands abuts one of the side walls and wherein one of the valleys of the uppermost edge of the other of the end upper bands abuts the one of the side walls.

12. The nestable beverage crate of claim 11 wherein a nesting height of the nestable beverage crate is the height of the side upper bands.

* * * * *